US005435025A

United States Patent [19]

Gerard et al.

[11] Patent Number: 5,435,025

[45] Date of Patent: Jul. 25, 1995

[54] ROLL-UP BEACH TOWEL KIT

[76] Inventors: Robert B. Gerard, 6275 Avenida Floresta, Rancho Santa Fe, Calif. 92067; Nicholas W. Ippolito, 36 Gehrig St., Commack, N.Y. 11725

[21] Appl. No.: 251,049

[22] Filed: May 31, 1994

[51] Int. Cl.[6] ..... A47G 9/06

[52] U.S. Cl. ..... 5/419; 5/417

[58] Field of Search ..... 5/417, 418, 419, 420; 190/1, 2; 383/4; 297/452.63

[56] References Cited

U.S. PATENT DOCUMENTS

| | | | |
|---|---|---|---|
| D. 318,772 | 8/1991 | Phillips | 5/419 |
| 609,696 | 8/1898 | Nicolle | 190/1 |
| 3,263,246 | 8/1966 | Towery | 383/4 |
| 3,363,667 | 1/1968 | Thomas et al. | 297/452.63 |
| 4,154,323 | 5/1979 | Sneider | 190/2 |
| 4,164,275 | 8/1979 | Davis | 5/417 |
| 4,222,468 | 9/1980 | DeFries | 5/417 |
| 4,272,575 | 6/1981 | Egigian | 5/417 |
| 4,970,741 | 11/1990 | Spina | 5/417 |
| 5,076,405 | 12/1991 | Modica | 5/417 |
| 5,081,727 | 1/1992 | Ippolito | 5/417 |

FOREIGN PATENT DOCUMENTS

| | | | |
|---|---|---|---|
| 2540366 | 8/1984 | France | 5/417 |
| 2666493 | 3/1992 | France | 5/417 |
| 146417 | 7/1931 | Switzerland | 5/418 |

*Primary Examiner*—Michael J. Milano

*Attorney, Agent, or Firm*—Brown, Martin, Haller & McClain

[57] ABSTRACT

A towel is attached along one of its edges to a hollow, insulating tube. The towel may be rolled up or wound around the tube. Articles such as cold beverage cans may be placed in the tube. Two removable endcaps may be used to close the ends of the tube and thus retain the articles. In the rolled-up position, two or more snaps near the free end of the towel may be used to secure the towel around the circumference of the tube. A strap connecting the endcaps facilitates transportation of the tube and rolled-up towel.

8 Claims, 1 Drawing Sheet

ROLL-UP BEACH TOWEL KIT

BACKGROUND OF THE INVENTION

Preparing for and spending a day at a beach, park or other outdoor location can become a cumbersome ordeal due to the number of items that an individual may require in order to be comfortable during the outing. For example, an outing at the beach typically involves toting a towel or blanket, an insulated cooler for cold drinks and snacks, suntan lotion or sunscreen, and equipment for various sports activities. If the individual must park at some distance away from the beach, it is often problematic to carry all of his or her equipment during an extended walk to the beach, requiring multiple trips or resulting in frustration when the individual keeps dropping items.

Roll-up beach kits have been developed for facilitating the transportation of both a towel and an insulated cooler. Such kits typically comprise a tube made of an insulating foamed plastic material that can be rolled up in a towel. One end of the towel is attached to the tube. For example, U.S. Pat. No. 5,081,727, issued to Ippolito, one of the co-inventors of the present invention, discloses a towel having a loop in one end. The towel is attached to the tube by slipping the tube into the sleeve-like loop. Two hinged endcaps retain articles such as beverage cans in the tube. When the towel is rolled up around the tube, a user can carry the kit with the tube in a horizontal orientation by gripping two handles on the towel. Hook-and-loop or VELCRO®-type fasteners on the towel secure it in the rolled-up position. When the towel is unrolled on the ground, a user may lie on the towel, using the soft tube as a pillow.

The above-described beach kit has a few disadvantages in that it may be inconvenient to carry due to the limited flexibility of the handles. Further, the above-described beach kit is not economical to manufacture. the loop in the towel is formed by folding an edge of the towel back onto the body of the towel and securing it with stitching. An elastic band is sewn into the seam between the edge of the towel and the body to enhance retention of the towel on the tube. Although these features allow the towel to be securely connected to the tube, they require multiple manufacturing steps, increasing the ultimate cost to the consumer.

The above problems and deficiencies are clearly felt in the art and are solved by the present invention in the manner described below.

BRIEF SUMMARY OF THE INVENTION

It is an advantage of the present invention to provide a roll-up outing kit that is economical to manufacture and that can easily be carried.

In an exemplary embodiment, the present invention comprises a hollow, insulating tube, a towel attached along one edge to said tube, an endcap at each end of the tube, and a strap connecting the endcaps. The tube may be made of any suitable, soft insulating material such as foamed plastic. The bore in the tube should be sufficiently large to accommodate typical beverage cans. The towel is attached to the tube in an economical manner by inserting one edge into a slit along the length of the tube. With that edge secured to the tube, the towel may then be rolled up or wound around the tube.

In the rolled-up position, two or more snaps near the free end of the towel may be used to secure the towel around the circumference of the tube. A user may then place beverage cans or other articles in the tube and secure the endcaps over the ends. The user may transport the present invention by slinging the strap over his shoulder with the tube in a non-horizontal orientation. The articles in the tube settle at the lower end of the tube and do not shift while the invention is transported. A suitable swivel, such as a rivet or swivel-eye connector, between each endcap and an end of the strap prevents the strap from twisting.

BRIEF DESCRIPTION OF THE DRAWINGS

Understanding of the present invention will be facilitated by consideration of the following detailed description of a preferred embodiment of the present invention, taken in conjunction with the accompanying drawings, in which like reference numerals refer to like parts and in which.

DETAILED DESCRIPTION OF A PREFERRED EMBODIMENT

Figure 1:
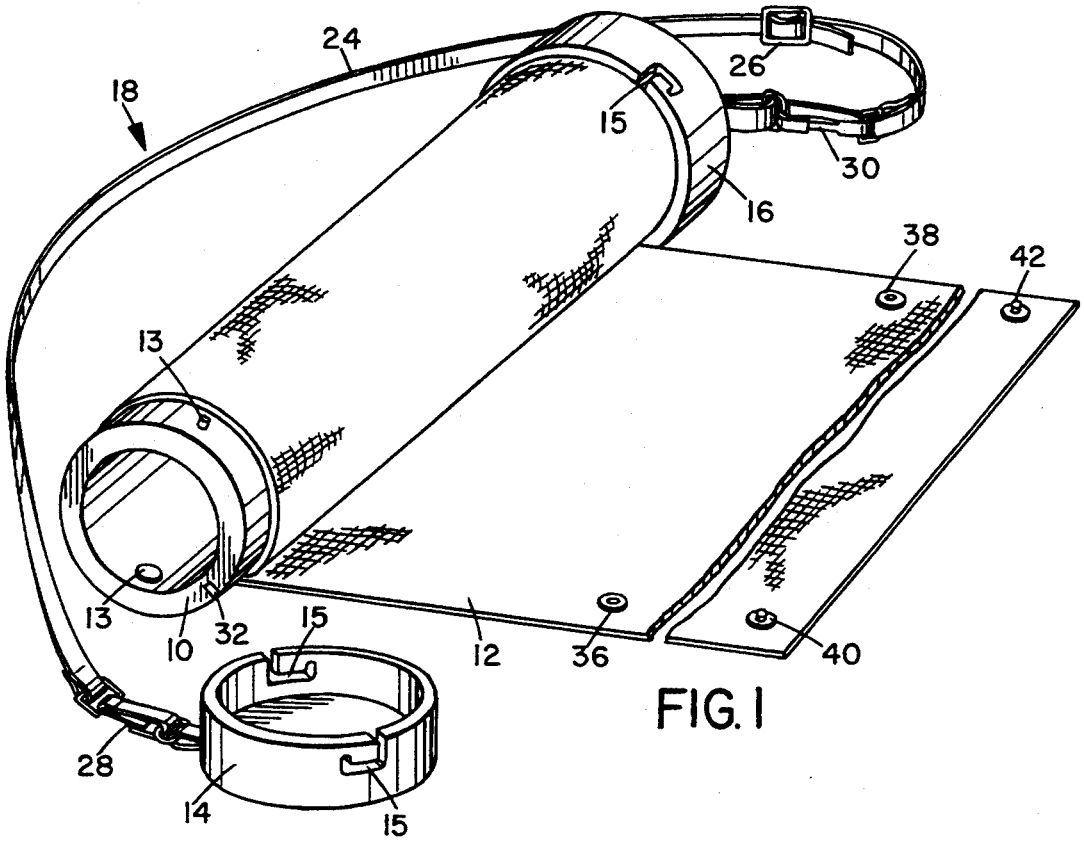
FIG. 1 is a perspective view of the present invention in an unrolled position with an endcap removed.
Figure 2:
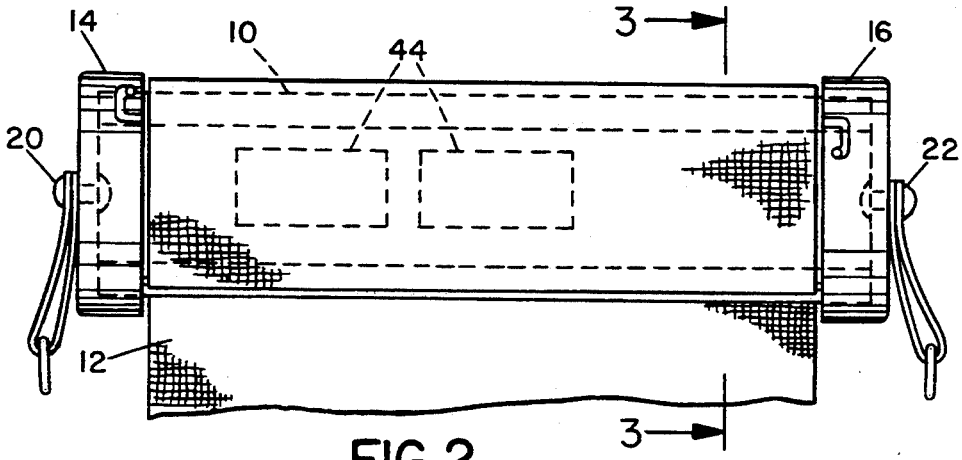
FIG. 2 is a top plan view of the tube portion of the present invention in a partially unrolled position with the endcaps in place.
Figure 3:
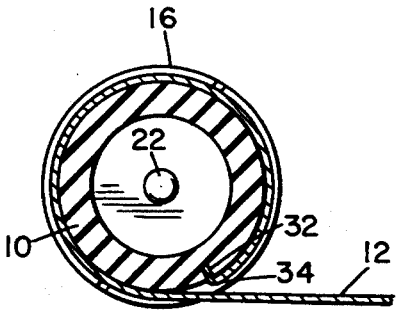
FIG. 3 is sectional view taken along line 3—3 of FIG. 2.

As illustrated in FIGS. 1–3, a hollow, elongated cylindrical tube 10 made of foamed plastic is attached to a towel 12. Two generally disc-shaped endcaps 14 and 16 can be placed over the ends of tube 10. Endcaps 14 and 16 fit snugly to minimize the possibility of their inadvertent removal from the ends of tube 10. For example, releasable but secure attachment of the endcaps may be provided by including pins for insertion through bores in the endcaps and into corresponding bores in the tube, or by providing bayonet-type locks comprising locking pins 13 and corresponding channels 15 as shown in FIG. 1. These fasteners, as well as other types of appropriate fastening means, are known in the art.

Towel 12 has a width approximately equal to or slightly narrower than the distance between endcaps 14 and 16 to prevent it from interfering with removal and attachment of endcaps 14 and 16. Towel 12 may be made of any suitable material of which beach towels are commonly made, such as terry cloth.

Each end of a strap 18 is connected to one of endcaps 14 and 16 using rivets 20 and 22, respectively. Rivets 20 and 22 allow strap 18 to swivel, thereby reducing twisting of strap 18. Strap 18 preferably comprises a length of flat webbing 24, typically made of nylon or similar material, a slide 26 for adjusting the length of strap 18, and two removable hooks 28 and 30 at the ends of strap 18. Additional separate loops or fasteners may be provided on the strap for releasably fastening other items, such as car keys or a small portable radio, tape player or the like, for carrying.

Towel 12 is attached to tube 10 in a manner that maximizes economy of manufacture, as well as allowing the user to easily remove the towel for drying off after swimming or for laundering the towel. Tube 10 has a longitudinal slit 32 on its outer surface into which one end 34 of towel 12 is inserted. The slit 32 should be of sufficient depth to retain the towel, but not so deep as to compromise the integrity of the tube. It may be desirable to cut the slit at a shallow angle through a greater thickness of the tube wall rather than directly radially from the tube's center. End 34 of towel 12 is thus frictionally and resiliently retained in slit 32. The absence of fasteners or modifications to end 34 of towel 12 reduces manufacturing complexity.

Figure 4:
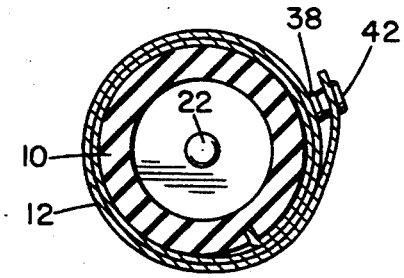
FIG. 4 is a view similar to FIG. 3, showing the present invention in a rolled-up position.

To use the outing kit of the present invention, a user may roll or wind towel 12 around tube 10. Two snap fasteners, comprising male snap halves 36 and 38 and female snap halves 40 and 42, are attached towel 12 near the end most distant from end 34. Each snap fastener has its respective male and female halves spaced apart by a distance approximately equal to the circumference of the present invention in its rolled-up position. Therefore, when towel 12 is in the rolled-up position the user may engage male snap half 36 in female snap half 40 and engage male snap half 38 in female snap half 42, as illustrated in FIG. 4.

The user may place articles, such as cold beverage cans 44, small snacks, bottles of suntan lotion or sunscreen, and other personal effects, inside tube 10. The user may then cover the ends of tube 10 with endcaps 14 and 16. The insulating properties of tube 10 keep cans 44 and other food items cold. To transport the present invention, the user may sling strap 18 over his shoulder with tube 10 in a non-horizontal orientation. In this orientation, cans 44 remain at one end of tube 10 and do not shift as the user walks. Unlike prior art devices with handles, the present invention is not cumbersome to carry because it need not be balanced in a horizontal orientation. Also, the ability to sling the outing kit over his or her shoulder frees the user's hands for carrying sports equipment or other items.

When the user reaches the destination, he or she may remove endcap 14 or 16 to retrieve a can 44 or other item that was placed therein. The user may unsnap the fasteners and unroll towel 12. While lying on the unrolled towel 12, the user may rest his or her head on tube 10.

It will be evident that there are additional embodiments and applications which are not disclosed in the detailed description but which clearly fall within the scope and spirit of the present invention. The specification is, therefore, not intended to be limiting, and the scope of the invention is to be limited only by the following claims.

We claim:

1. A outing kit, comprising:

a hollow, generally cylindrical, insulating tube, said tube having a diameter, a thickness, first and second open ends, and a slit along its length between said first and second open ends, said slit having a depth less than the thickness of the tube;

a towel having an end frictionally retained in said slit, said towel rollable around said tube; and a first endcap closing said first open end;

a second endcap removably closing said second open end; and a strap having first and second strap ends, said first strap end connected to said first endcap, said second strap end connected to said second endcap.

2. The outing kit claimed in claim 1, wherein said towel has a plurality of snap fasteners for securing it in a rolled-up position.

3. The outing kit claimed in claim 1, wherein said first and second strap ends are pivotally connected to said first and second endcaps.

4. The outing kit claimed in claim 3, wherein a first rivet connects said first strap end to said first endcap, and a second rivet connects said second strap end to said second endcap.

5. The outing kit claimed in claim 1, wherein said first and second endcaps each have a generally cylindrical tubular shape with an open endcap end and a closed endcap end, said open endcap end having a diameter approximately equal to said diameter of said tube.

6. The outing kit claimed in claim 1, wherein said strap comprises a length of generally flat webbing and a slide, said slide for adjusting the length of said strap by forming a loop of a selected length in said webbing.

7. The outing kit claimed in claim 6, wherein said strap further comprises two hooks for releasably attaching said strap to said endcaps.

8. The outing kit claimed in claim 1 further comprising fasteners for releasably securing said endcaps to said tube.

* * * * *